US009396693B2

(12) United States Patent
Kuno

(10) Patent No.: US 9,396,693 B2
(45) Date of Patent: Jul. 19, 2016

(54) CONTROLLER, DISPLAY DEVICE HAVING THE SAME, AND COMPUTER READABLE MEDIUM FOR THE SAME

(71) Applicant: Masashi Kuno, Obu (JP)

(72) Inventor: Masashi Kuno, Obu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 255 days.

(21) Appl. No.: 14/034,686

(22) Filed: Sep. 24, 2013

(65) Prior Publication Data

US 2014/0146089 A1 May 29, 2014

(30) Foreign Application Priority Data

Nov. 29, 2012 (JP) ..... 2012-261385

(51) Int. Cl.
*G09G 3/36* (2006.01)
*G09G 5/10* (2006.01)
*G09G 3/34* (2006.01)

(52) U.S. Cl.
CPC ..... *G09G 3/3696* (2013.01); *G09G 3/3406* (2013.01); *G09G 3/36* (2013.01); *G09G 5/10* (2013.01); *G09G 2320/0276* (2013.01); *G09G 2320/0626* (2013.01); *G09G 2320/0646* (2013.01); *G09G 2320/0673* (2013.01); *G09G 2360/144* (2013.01); *G09G 2360/16* (2013.01)

(58) Field of Classification Search
CPC ..... G09G 2360/16; G09G 2320/0646; G09G 3/3406; G09G 2360/144; G09G 2320/0276; G09G 2320/0673; G09G 2320/0626; G09G 5/10; G09G 3/36; G09G 3/3696
See application file for complete search history.

(56) References Cited

U.S. PATENT DOCUMENTS

| | | | | |
|---|---|---|---|---|
| 6,694,051 | B1 | 2/2004 | Yamazoe et al. | |
| 2004/0184673 | A1 | 9/2004 | Watanabe | |
| 2004/0246242 | A1 * | 12/2004 | Sasaki | 345/204 |
| 2004/0263456 | A1 * | 12/2004 | Miyachi et al. | 345/88 |
| 2006/0132424 | A1 * | 6/2006 | Foo et al. | 345/102 |
| 2006/0146005 | A1 * | 7/2006 | Baba et al. | 345/102 |
| 2006/0208999 | A1 * | 9/2006 | Lee et al. | 345/102 |
| 2006/0214904 | A1 * | 9/2006 | Kimura et al. | 345/102 |
| 2006/0221260 | A1 * | 10/2006 | Fujine et al. | 348/790 |
| 2006/0280360 | A1 * | 12/2006 | Holub | 382/162 |

(Continued)

FOREIGN PATENT DOCUMENTS

| | | | |
|---|---|---|---|
| JP | 11-65531 | A | 3/1999 |
| JP | 2000-134467 | A | 5/2000 |

(Continued)

*Primary Examiner* — Michael J Eurice
(74) *Attorney, Agent, or Firm* — Scully, Scott, Murphy & Presser, P.C.

(57) ABSTRACT

A controller configured to control a display unit configured to change a maximum luminescence level is provided, the controller including a setting acquirer acquiring a setting value associated with the maximum luminescence level, an image data acquirer acquiring target image data, a feature value acquirer acquiring a feature value correlated with a brightness of a target image expressed by the target image data, using pixel values contained in the target image data, a corrector applying to the target image data a correction for adjusting the brightness of the target image using the setting value associated with the maximum luminescence level and the feature value correlated with the brightness of the target image, and a display controller controlling the display unit to display the target image expressed by the corrected target image data.

13 Claims, 9 Drawing Sheets

(56) References Cited

U.S. PATENT DOCUMENTS

| | | | | |
|---|---|---|---|---|
| 2007/0124122 | A1* | 5/2007 | Freier | 703/2 |
| 2007/0279372 | A1* | 12/2007 | Brown Elliott et al. | 345/102 |
| 2008/0043135 | A1* | 2/2008 | Sugimoto | 348/345 |
| 2008/0186393 | A1* | 8/2008 | Lee et al. | 348/301 |
| 2009/0289890 | A1* | 11/2009 | Tsuchida et al. | 345/102 |
| 2011/0115815 | A1 | 5/2011 | Xu et al. | |
| 2012/0287143 | A1* | 11/2012 | Brown Elliott | 345/589 |

FOREIGN PATENT DOCUMENTS

| | | | |
|---|---|---|---|
| JP | 2004-282416 | A | 10/2004 |
| JP | 2011-107702 | A | 6/2011 |

* cited by examiner

| BACKLIGHT SETTING VALUE BS | AVERAGE PIXEL VALUE Vave | BASE CORRECTION LEVEL AL1 |
|---|---|---|
| 1: DARK | Tv1 > Vave ≧ 0 | 2 |
| | Tv2 > Vave ≧ Tv1 | 1 |
| | Vave ≧ Tv2 | 0 |
| 3: BRIGHT | Tv3 > Vave ≧ 0 | 0 |
| | Tv4 > Vave ≧ Tv3 | −1 |
| | Vave ≧ Tv4 | −2 |

EX. Tv1=96 Tv2=128
Tv3=120 Tv4=150

FIG. 6

EXAMPLES OF CORRECTION LEVELS WHEN BACKLIGHT SETTING VALUE = "1"

| | AVERAGE PIXEL VALUE Vave | BASE CORRECTION LEVEL AL1 | STANDARD DEVIATION σ | BACKLIGHTING DETERMINATION | ADDITIONAL CORRECTION LEVEL AL2 | CORRECTION LEVEL AL |
|---|---|---|---|---|---|---|
| IMAGE1 | 120.13 | 1 | 65.29 | | 0 | 1 |
| IMAGE2 | 82.94 | 2 | 41.92 | | 0 | 2 |
| IMAGE3 | 122.34 | 1 | 97.21 | ○ | 1 | 2 |
| IMAGE4 | 122.92 | 1 | 74.26 | ○ | 1 | 2 |
| IMAGE5 | 60.39 | 2 | 65.57 | | 0 | 2 |
| IMAGE6 | 151.76 | 0 | 96 | ○ | 1 | 1 |
| IMAGE7 | 91.3 | 2 | 65.55 | | 0 | 2 |
| IMAGE8 | 118.73 | 1 | 65.42 | | 0 | 1 |
| IMAGE9 | 53.22 | 2 | 52.29 | | 0 | 2 |
| IMAGE10 | 102.95 | 1 | 66.03 | | 0 | 1 |
| IMAGE11 | 84.59 | 2 | 78.92 | ○ | 1 | 2 |
| IMAGE12 | 166.1 | 0 | 67.46 | | 0 | 0 |

FIG. 8

EXAMPLES OF CORRECTION LEVELS WHEN BACKLIGHT SETTING VALUE = "3"

| | AVERAGE PIXEL VALUE Vave | BASE CORRECTION LEVEL AL1 | STANDARD DEVIATION σ | BACKLIGHTING DETERMINATION | ADDITIONAL CORRECTION LEVEL AL2 | CORRECTION LEVEL AL |
|---|---|---|---|---|---|---|
| IMAGE1 | 120.13 | −1 | 65.29 | | 0 | −1 |
| IMAGE2 | 82.94 | 0 | 41.92 | | 0 | 0 |
| IMAGE3 | 122.34 | −1 | 97.21 | ○ | 1 | 0 |
| IMAGE4 | 122.92 | −1 | 74.26 | ○ | 1 | 0 |
| IMAGE5 | 60.39 | 0 | 65.57 | | 0 | 0 |
| IMAGE6 | 151.76 | −2 | 96 | ○ | 1 | −1 |
| IMAGE7 | 91.3 | 0 | 65.55 | | 0 | 0 |
| IMAGE8 | 118.73 | 0 | 65.42 | | 0 | 0 |
| IMAGE9 | 53.22 | 0 | 52.29 | | 0 | 0 |
| IMAGE10 | 102.95 | 0 | 66.03 | | 0 | 0 |
| IMAGE11 | 84.59 | 0 | 78.92 | ○ | 1 | 0 |
| IMAGE12 | 166.1 | −2 | 67.46 | | 0 | −2 |

FIG. 9

CONTROLLER, DISPLAY DEVICE HAVING THE SAME, AND COMPUTER READABLE MEDIUM FOR THE SAME

CROSS-REFERENCE TO RELATED APPLICATION

This application claims priority under 35 U.S.C. §119 from Japanese Patent Application No. 2012-261385 filed on Nov. 29, 2012. The entire subject matter of the application is incorporated herein by reference.

BACKGROUND

1. Technical Field

The following description relates to one or more techniques for controlling a display device configured to change a maximum luminescence level.

2. Related Art

A liquid crystal display (LCD) device is configured to update a maximum luminescence level in response to changes in an illuminance (an illumination intensity) of a backlight. For instance, it is possible to reduce power consumption of the LCD device by lowering the illuminance of the backlight. A technique has been known that makes it possible to correct image data expressing an image to be displayed, so as to maintain brightness of the image displayed on the LCD device with a lowered illuminance of the backlight. In the technique, a correction for raising the brightness of the image depending on a reduction ratio of the illuminance of the backlight is applied to the image data.

SUMMARY

However, the known technique is not adapted in adequate consideration of properties of the image to be displayed. Therefore, the image expressed by the image data corrected by the technique might actually be displayed on the LCD device with a deteriorated level of visual quality. This kind of problem is not specific to the LCD device but is in common with a control technique for controlling a display device configured to change the maximum luminescence level.

Aspects of the present invention are advantageous to present one or more improved techniques that make it possible to prevent deterioration of visual quality of an image displayed on a display device configured to change the maximum luminescence level.

According to aspects of the present invention, a controller configured to control a display unit configured to change a maximum luminescence level is provided, the controller including a setting acquirer configured to acquire a setting value associated with the maximum luminescence level of the display unit, an image data acquirer configured to acquire target image data, a feature value acquirer configured to acquire a feature value correlated with a brightness of a target image expressed by the target image data, using a plurality of pixel values contained in the target image data, a corrector configured to apply, to the target image data, a correction for adjusting the brightness of the target image using the setting value associated with the maximum luminescence level of the display unit and the feature value correlated with the brightness of the target image, and a display controller configured to control the display unit to display the target image expressed by the corrected target image data.

According to aspects of the present invention, further provided is a display device, which includes a display panel, an illuminator configured to illuminate the display panel, a driver configured to control an illuminance of the illuminator and change a maximum luminescence level, and a controller configured to perform acquiring a setting value associated with the maximum luminescence level of the display device, acquiring target image data, acquiring a feature value correlated with a brightness of a target image expressed by the target image data, using a plurality of pixel values contained in the target image data, applying, to the target image data, a correction for adjusting the brightness of the target image using the setting value associated with the maximum luminescence level of the display device and the feature value correlated with the brightness of the target image, and displaying on the display panel the target image expressed by the corrected target image data.

According to aspects of the present invention, further provided is anon-transitory computer readable medium storing computer readable instructions configured to, when executed by a computer connected with a display device configured to change a maximum luminescence level, cause the computer to perform acquiring a setting value associated with the maximum luminescence level of the display device, acquiring target image data, acquiring a feature value correlated with a brightness of a target image expressed by the target image data, using a plurality of pixel values contained in the target image data, applying, to the target image data, a correction for adjusting the brightness of the target image using the setting value associated with the maximum luminescence level of the display device and the feature value correlated with the brightness of the target image, controlling the display device to display the target image expressed by the corrected target image data.

BRIEF DESCRIPTION OF THE ACCOMPANYING DRAWINGS

Figure 4:
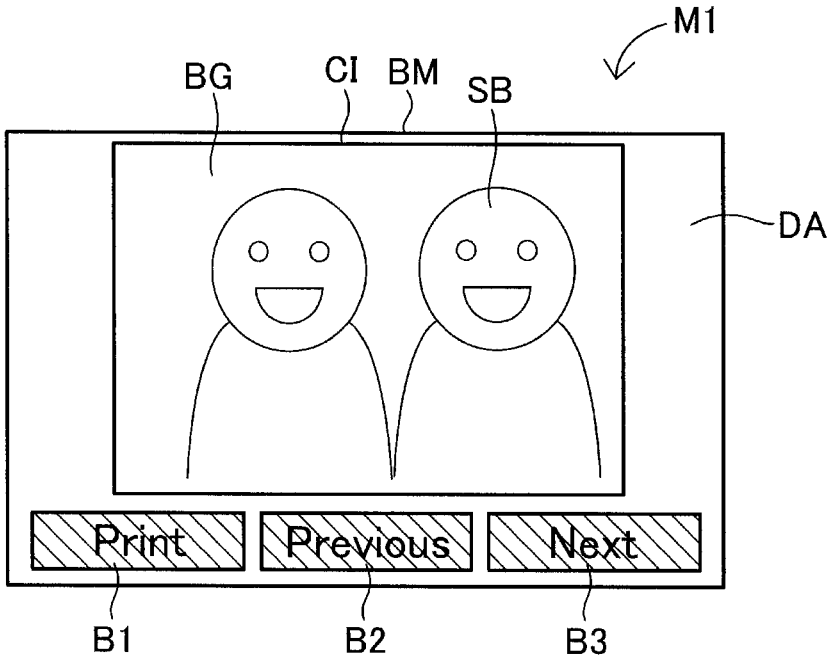

FIG. 4 exemplifies a UT screen image in the first embodiment according to one or more aspects of the present invention.

Figure 5A:
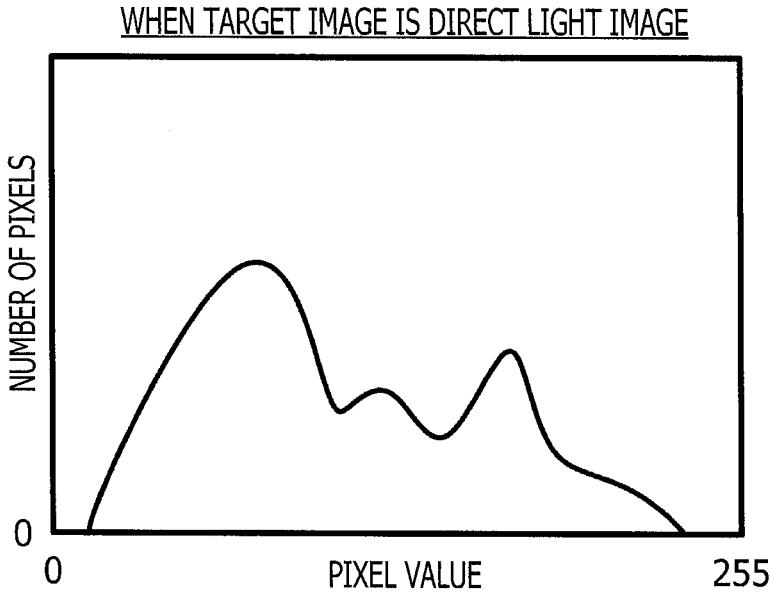

FIG. 5A exemplifies a histogram showing a pixel value distribution of target image data expressing a photographic image taken in a direct light condition in the first embodiment according to one or more aspects of the present invention.

Figure 5B:
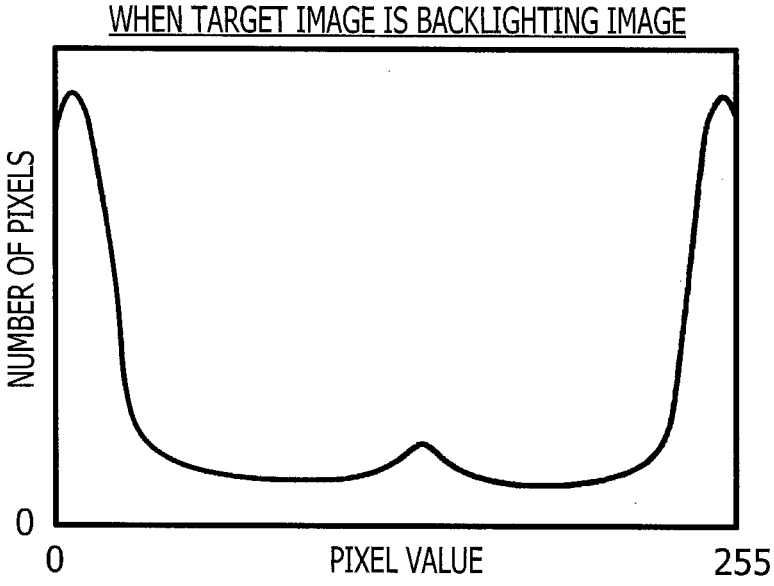

FIG. 5B exemplifies a histogram showing a pixel value distribution of target image data expressing a photographic image taken in a backlighting condition in the first embodiment according to one or more aspects of the present invention.

FIG. 6 is a table for explaining how to determine a base correction level in the first embodiment according to one or more aspects of the present invention.

Figure 7:
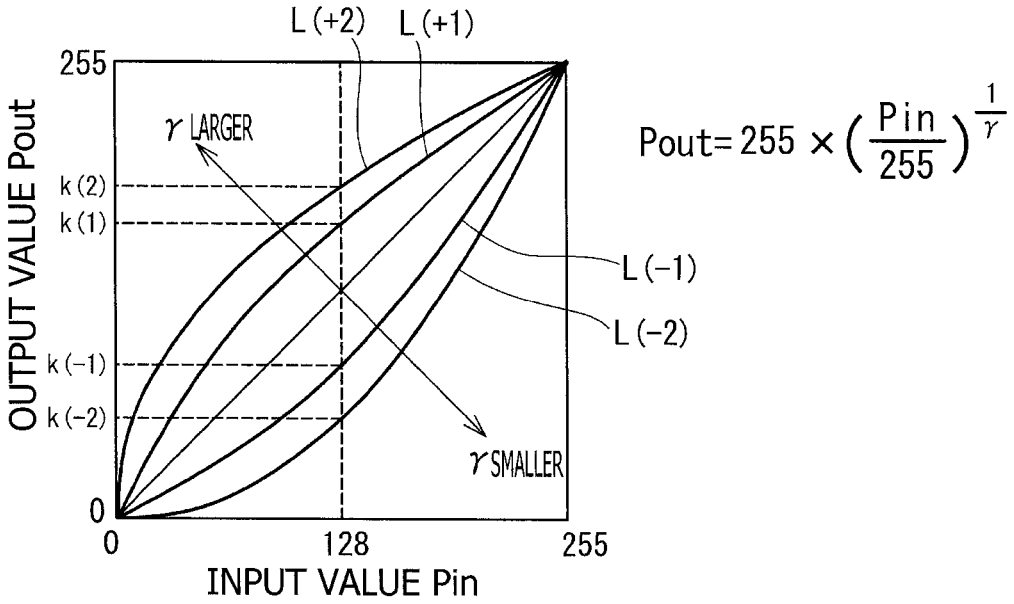

FIG. 7 exemplifies one-dimensional lookup tables used for a correction for adjusting a brightness of a target image in the first embodiment according to one or more aspects of the present invention.

FIG. 8 exemplifies correction levels for 12 images when a backlight setting value is "1" (a display unit is set in a low luminescence mode) in the first embodiment according to one or more aspects of the present invention.

FIG. 9 exemplifies correction levels for the 12 images 1 to 12 when the backlight setting value is "3" (the display unit is set in a high luminescence mode) in the first embodiment according to one or more aspects of the present invention.

Figure 10A:
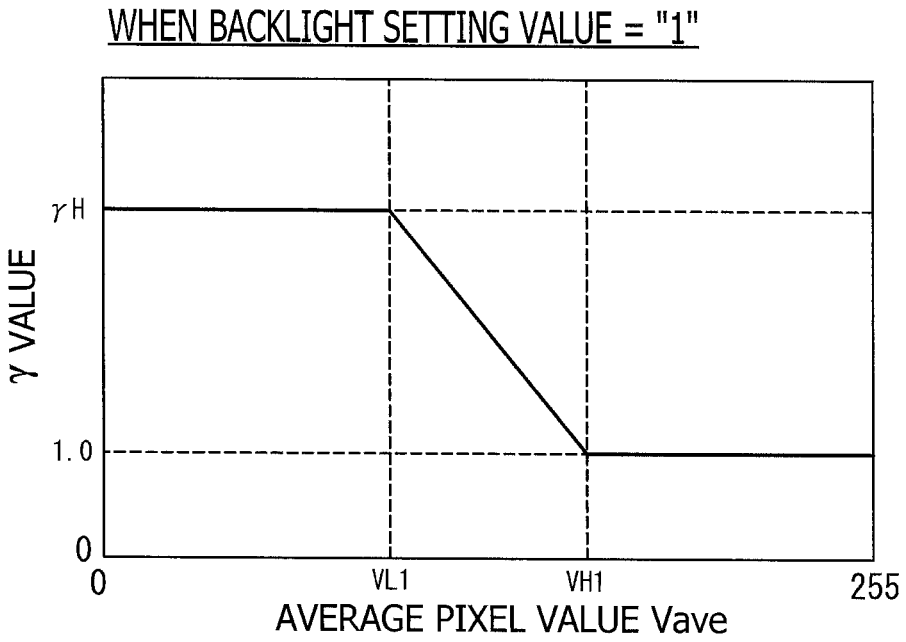

FIG. 10A exemplifies a relationship between an average pixel value and a γ value when the backlight setting value is "1" (the display unit is set in the low luminescence mode) in a second embodiment according to one or more aspects of the present invention.

Figure 10B:
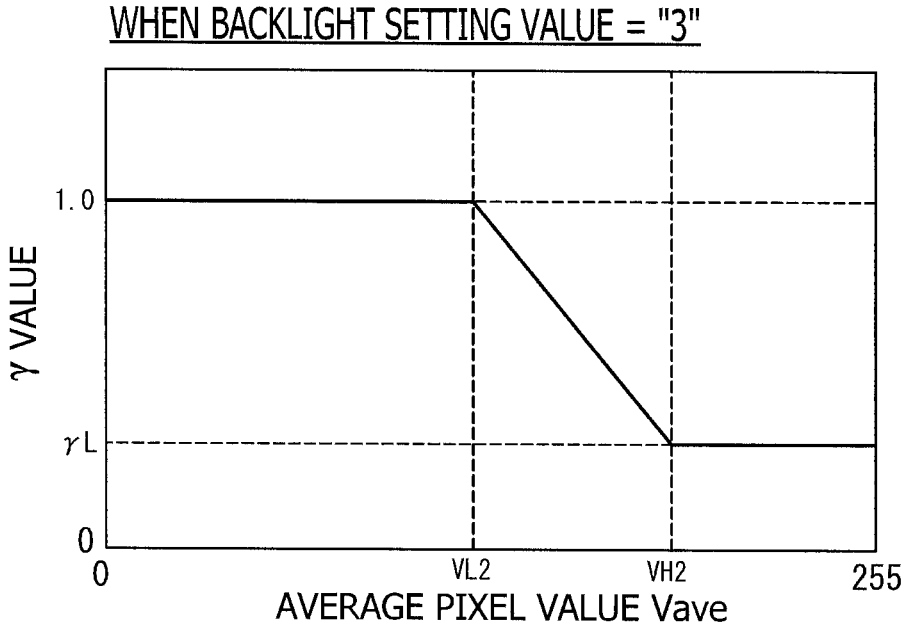

FIG. 10B exemplifies a relationship between the average pixel value and the γ value when the backlight setting value is "3" (the display unit is set in the high luminescence mode) in the second embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented on circuits (such as application specific integrated circuits) or in computer software as programs storable on computer readable media including but not limited to RAMs, ROMs, flash memories, EEPROMs, CD-media, DVD-media, temporary storage, hard disk drives, floppy drives, permanent storage, and the like.

Hereinafter, embodiments according to aspects of the present invention will be described with reference to the accompanying drawings.

A. First Embodiment

A-1. Configuration of Multi-Function Peripheral

Figure 1:
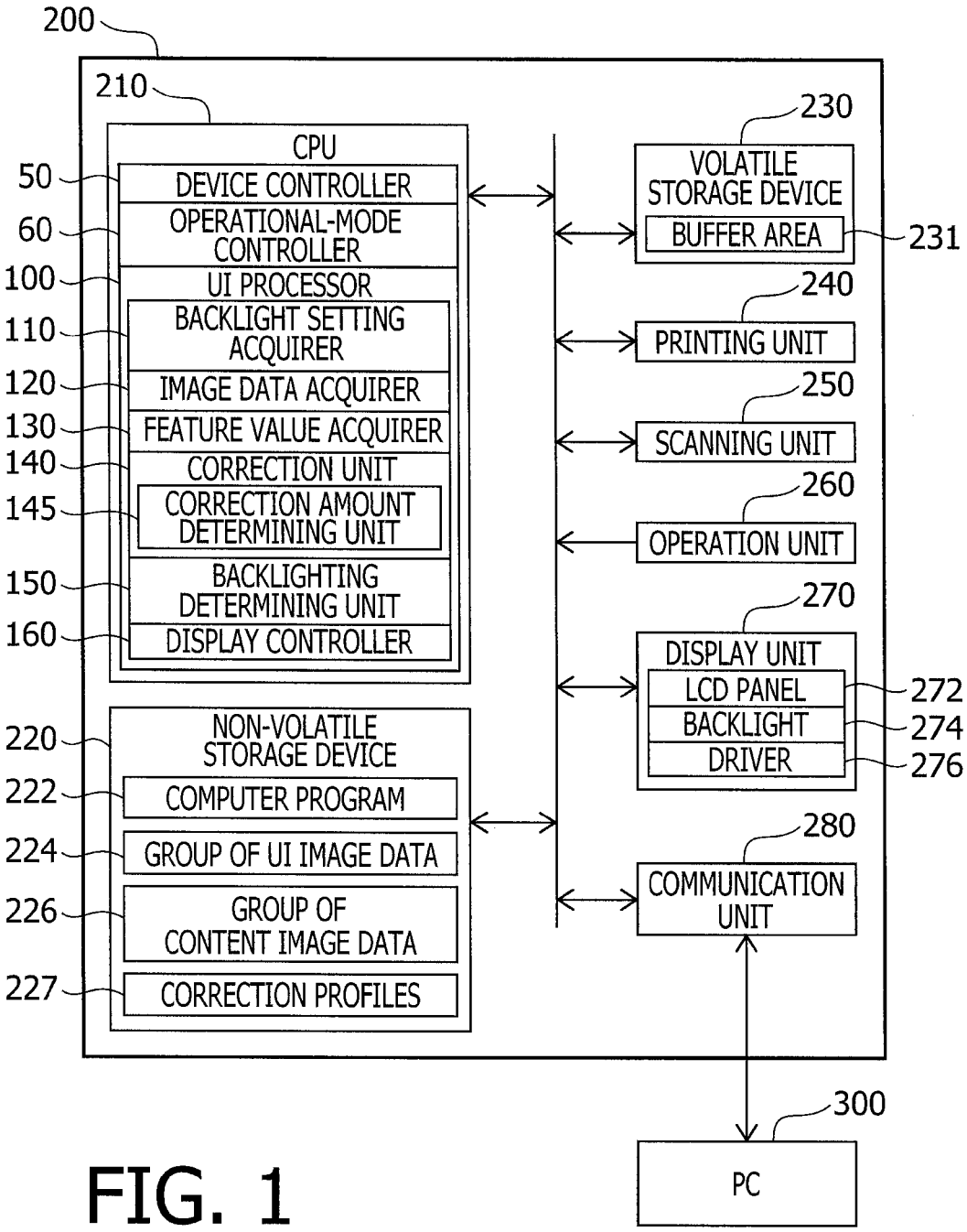
FIG. 1 is a block diagram showing a configuration of a multi-function peripheral (MFP) in a first embodiment according to one or more aspects of the present invention.

FIG. 1 is a block diagram showing a configuration of a multi-function peripheral (MFP) 200 is a first embodiment.

The MFP 200 includes a CPU 210, a non-volatile storage device 220 such as a hard disk drive and an EEPROM, a volatile storage device 230 such as a RAM, a printing unit 240 configured to print an image in a predetermined method (such as an inkjet printing method and a laser printing method), a scanning unit 250 configured to read a document sheet using a photoelectric conversion element (such as a CCD and a CMOS), an operation unit 260 including a touch panel and buttons, a display unit 270, and a communication unit 280 configured to perform data communication with an external device such as a personal computer (PC) 300 and a USB memory (not shown).

The volatile storage device 230 includes a buffer area 231 configured to temporarily store various types of intermediate data created in processing by the CPU 210. The non-volatile storage device 220 is configured to store a computer program 222 for controlling the MFP 200, a group of UI image data 224, a group of content image data 226, and correction profiles 227.

The computer program 222 may previously be stored in the non-volatile storage device 220 before shipment of the MFP 200. Further, the computer program 222 may be provided in various fashions. For instance, the computer program 222 may be downloaded from a server connected with the MFP 200 via Internet, or may be provided in a state stored on a removable storage device such as a CD-ROM.

The group of UI image data 224 may contain a plurality of pieces of UI image data that represent a plurality of UI screen images, respectively, to present a graphical user interface (GUI) for the MFP 200. The group of contents image data 226 may contain image data (scanned data) created by the scanning unit 250, and image data to be processed by the printing unit 240. Further, the group of content image data 226 may contain image data that represents minified images (such as thumbnail images) of images represented by the above image data.

The UI image data and the content image data may be RGB image data including a plurality of pieces of RGB pixel data. A single piece of RGB pixel data contains three pixel values respectively corresponding to three kinds of color components (RGB). Each pixel value has a gradation value of a predetermined number of gradations (in the first embodiment, 256 gradations ranging from "0" to "255"). Hereinafter, the pixel value of the R component will be referred to as an "R value." The pixel value of the G component will be referred to as a "G value." The pixel value of the B component will be referred to as a "B value." The correction profiles 227 contain four lookup tables L (−2), L (−1), L (+1), and L (+2) adapted to be used for correction of a target image in below-mentioned image processing (see FIG. 7).

The display unit 270 may be used to display the UI screen images represented by the UI image data and the content images represented by the content image data. In the first embodiment, the display unit 270 is a liquid crystal display (LCD) device. The display unit 270 includes an LCD panel containing a plurality of pixels, a backlight 274 that includes light sources such as LEDs and is configured to illuminate the LCD panel 272 from an opposite side of a display side of the LCD panel 272, and a driver 276 configured to control the LCD panel and the backlight 274.

In the first embodiment, the LCD panel 272 is a color display panel of which each pixel contains three sub pixels corresponding to the three colors RGB. The driver 276 is configured to control a transmittance of each sub pixel and change a luminescence level of each sub pixel. The control of the transmittance of each sub pixel is implemented based on corresponding image data in the RGB image data supplied from the CPU 210 to the driver 276. Thereby, the LCD panel 272 is allowed to display a color image expressed by the RGB image data (such as the UI image data and the content image data). When each of the three sub pixels contained in each pixel of the LCD panel 272 is controlled to have a maximized transmittance, each pixel has a maximum luminescence level, which may be referred to as a "maximum luminescence level of the display unit 270." The maximum luminescence level of the display unit 270 varies depending on an illuminance of the backlight 274 (i.e., an illumination intensity of the light emitted from the backlight 274 to the LCD panel 272). The driver 276 is configured to control the illuminance of the backlight 274 in response to an instruction signal issued by a below-mentioned operational-mode controller 60 (see FIG. 1).

The CPU 210 is configured to, when executing the computer program 222, serve as a device controller 50, an operational-mode controller 60 for controlling an operational mode of the display unit 270, and a UI processor 100. The device controller 50 is configured to control the printing unit 240 and the scanning unit 250 to perform a copy operation, a printing operation, and a scanning operation. As will be described below, the UI processor 100 is configured to perform a series of image displaying operations to display the UI screen images on the display unit 270. The UI processor 100 includes a backlight setting acquirer 110, an image data acquirer 120, a feature value acquirer 130, a correction unit 140, a backlighting determining unit 150, and a display controller 160. The correction unit 140 includes a correction amount determining unit 145.

A-2. Image Processing

Figure 2:
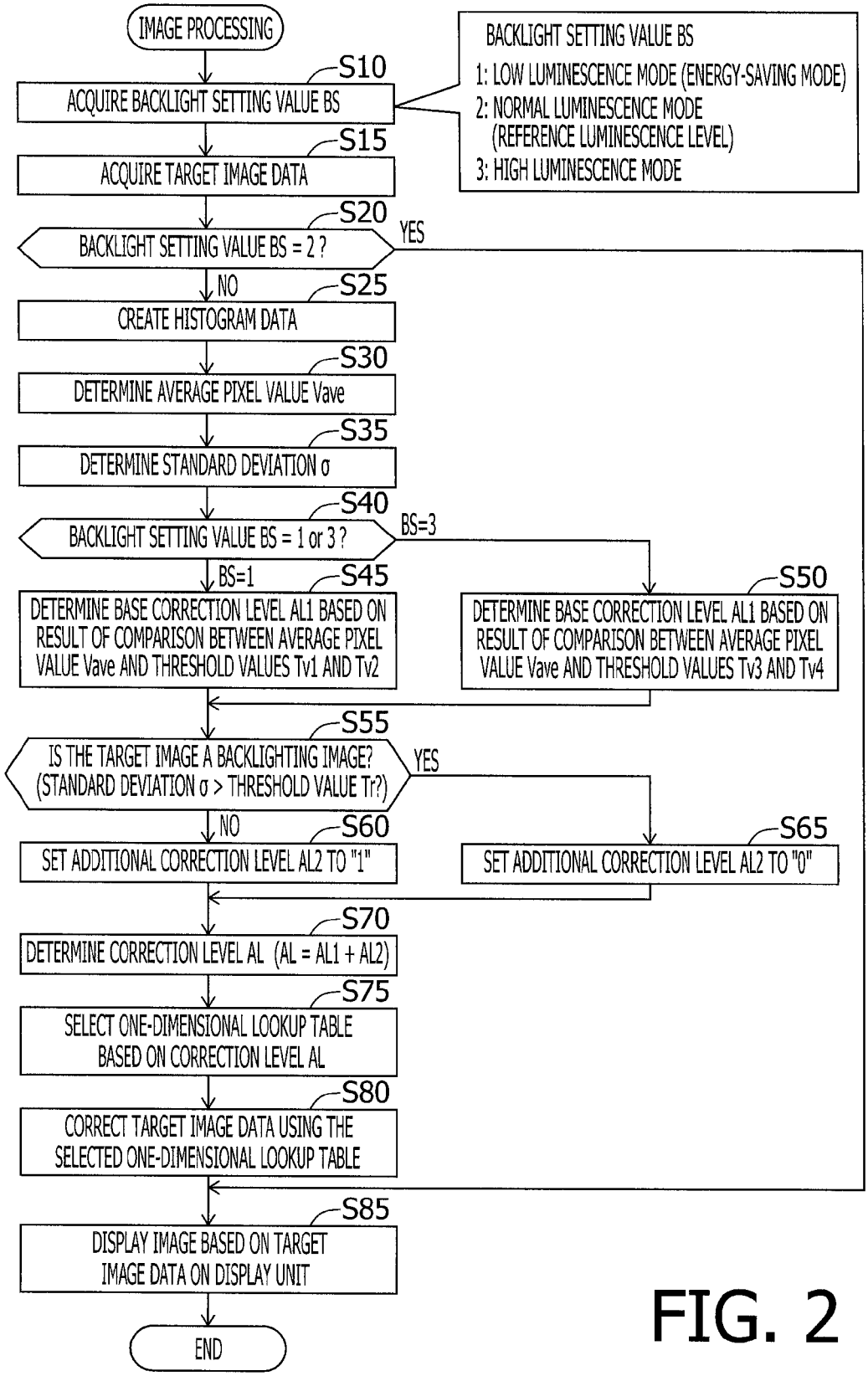
FIG. 2 is a flowchart showing a procedure of image processing in the first embodiment according to one or more aspects of the present invention.
Figure 3:
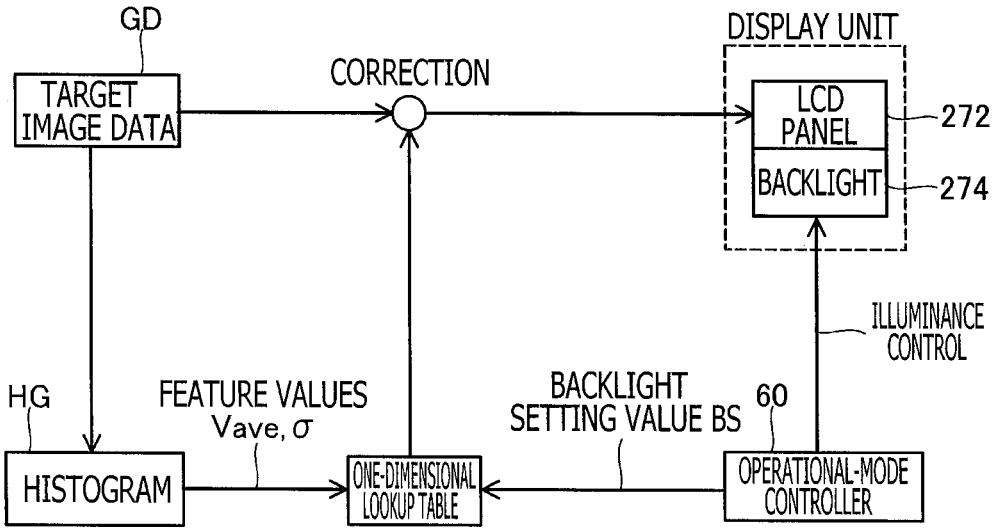
FIG. 3 is an illustration schematically showing the image processing in the first embodiment according to one or more aspects of the present invention.

FIG. 2 is a flowchart showing a procedure of image processing in the first embodiment. FIG. 3 is an illustration schematically showing the image processing in the first embodiment.

Before explanation of the image processing, the operational-mode controller 60 will be described. The operational-mode controller 60 is configured to control the operational mode of the display unit 270. In the first embodiment, the display unit 270 is configured to be set in one of three operational modes having respective different maximum luminescence levels, i.e., a low luminescence mode, a normal luminescence mode, and a high luminescence mode. The low luminescence mode is a mode in which the display unit 270 operates at a maximum luminescence level lower than a standard maximum luminescence level (which may be referred to as a "reference luminescence level"). For instance, the low luminescence mode may be a so-called energy-saving or power-saving mode set to reduce power consumption of the display unit 270. The normal luminescence mode is a mode in which the display unit 270 operates at the standard maximum luminescence level. The high luminescence mode is a mode in which the display unit 270 operates at a maximum luminescence level higher than the standard maximum luminescence level. For instance, the high luminescence mode may be set when a user wishes to raise the luminescence level of the display unit 270 in view of brightness of a room where the MFP 200 is installed. The normal luminescence mode is set as a default operational mode of the display unit 270. Even though using the same image data, the display unit 270, which is operating in the low luminescence mode, displays an image based on the image data darker than when the display unit 270 is operating in the normal luminescence mode. Meanwhile, the display unit 270, which is operating in the high luminescence mode, displays the image based on the image data brighter than when the display unit 270 is operating in the normal luminescence mode.

The operational-mode controller 60 is configured to control the illuminance of the backlight 274 by sending to the driver 276 a control signal corresponding to an operational mode selected from among the three operational modes based on an instruction from the user (see FIG. 3). Thereby, the illuminance of the backlight 274 in the low luminescence mode becomes lower than that in the normal luminescence mode, and the illuminance of the backlight 274 in the high luminescence mode becomes higher than that in the normal luminescence mode. The operational-mode controller 60 stores a backlight setting value BS (see FIG. 3) corresponding to the current illuminance of the backlight 274 into a predetermined area of the non-volatile storage device 220. The backlight setting value BS is also a setting value representing the current operational mode of the display unit 270. In the first embodiment, a backlight setting value BS corresponding to the low luminescence mode is "1." A backlight setting value BS corresponding to the normal luminescence mode is "2." A backlight setting value BS corresponding to the high luminescence mode is "3."

Subsequently, the image processing (see FIG. 2) in the first embodiment will be described. The image processing is executed by the UI processor 100 to display a UI screen image on the display unit 270. For example, the image processing is launched when the MFP 200 is powered on and becomes able to accept an instruction from the user, or when the MFP 200 updates a whole or a part of the UI screen image being displayed on the display unit 270.

When the image processing is started, in S10, the backlight setting acquirer 110 of the UI processor 100 acquires the aforementioned backlight setting value BS from the non-volatile storage device 220.

In S15, the image data acquirer 120 acquires target image data. The target image data is image data expressing a target image to be processed in below-mentioned correction (see S80), the target image which is a whole or a part of a UI screen image to be displayed on the display unit 270.

FIG. 4 exemplifies a UI screen image. The UI screen image M1 exemplified in FIG. 4 includes a base image BM, and a content image CI superimposed on the base image BM. The base image BM includes three buttons B1, B2, and B2, and a content image display area DA on which the content image CI is superimposed. The base image BM is an image expressed by a single piece of UI image data contained in the aforementioned group of UI image data 224. By pressing one of the three buttons B1 to B3, the user is allowed to issue an instruction (e.g., a print instruction) to the MFP 200. For instance, the first button B1 is configured to accept a print instruction to print the content image CI displayed in a manner superimposed on the content image display area DA. Further, the second button B2 and the third button B3 are configured to accept a switching instruction to switch from the content image CI displayed in a manner superimposed on the content image display area DA to another content image. The content image CI is an image expressed by a single piece of content image data contained the aforementioned group of content image data 226. The content image CI may include photographic images, drawing images such as illustrations and graphics, and character (letter) images. FIG. 4 exemplifies a content image CI representing a photographic image, which includes subjects SB (representing two persons) and a background BG of the subjects SB.

In the first embodiment, the image data acquirer 120 acquires, as the target image data, the content image CI superimposed on the base image BM. Alternatively, the image data acquirer 120 may acquire, as the target image data, image data expressing the whole UI screen image that includes the base image BM and the content image CI superimposed on the base image BM. The acquired target image data is stored in the buffer area 231.

In S20, the UI processor 100 determines whether the backlight setting value BS is "2." When determining that the backlight setting value BS is "2" (S20: Yes), the UI processor 100 goes to S85 without executing the steps S25 to S80. Namely, when the display unit 270 operates in the normal luminescence mode, i.e., when the maximum luminescence level of the display unit 270 is set to the standard maximum luminescence level, the correction is not applied to the target image data.

When determining that the backlight setting value BS is not "2" (S20: No), that is, when determining that the backlight setting value BS is "1" or "3," the UI processor 100 goes to S25, in which the feature value acquirer 130 creates histogram data.

FIGS. 5A and 5B exemplify histograms HG representing pixel value distributions of the target image data. FIG. 5A shows a histogram HG of the target image data which represents a photographic image (a direct light image) taken in a direct light condition. FIG. 5B shows a histogram HG of the target image data which represents a photographic image (a backlighting image) taken in a backlighting condition. The histogram data is obtained by sorting all the pixel values contained in the target image data by the gradation value (i.e., according to the gradation value of 256 gradations) and counting the number of pixels separated for each gradation value. FIGS. 5A and 5B show histograms HG obtained by plotting each value of the created histogram data on a graph with the gradation value (ranging from "0" to "255" in the first embodiment) as a horizontal axis and the number of pixels separated for each gradation value as a vertical axis. In the first embodiment, the feature value acquirer 130 counts the number of pixels separated for each gradation value without distinguishing among the three kinds of pixel values (i.e., the R value, the B value, and the G value) to create the histogram data representing a single histogram HG. Namely, the summation of the frequency for every gradation value is equivalent to three times as large as a pixel number M (the pixel number M×3). The pixel number M is a total number of the pixels contained in the target image expressed by the target image data.

In S30, the feature value acquirer 130 determines an average pixel value Vave using the histogram data created in S25. The average pixel value Vave is an average value of all the pixel values contained in the target image data (i.e., the pixel values three times as many as the pixel number M).

A brightness value (a brightness value in the YUV color system) of a single piece of pixel data (a set of the R value, the G value, and the B value) is determined using the following expression (1).

$$\text{Brightness Value } Y=((0.298912\times R)+(0.586611\times G)+(0.114478\times B)) \quad \text{[Expression (1)]}$$

As understood from the expression (1), the R value, the G value, and the B value have respective different rate of contribution to the brightness value Y, but each of the three values has a positive correlation with the brightness value Y. Accordingly, the average pixel value Vave is regarded as a feature value representing the brightness of the target image expressed by the target image data (a feature value having a positive correlation with the brightness of the target image expressed by the target image data).

In the present disclosure, a "brightness value of pixel data" is a brightness value obtained using the pixel data and uniquely determined for a single piece of the pixel data, and is employed as a term representing brightness of a color expressed by the pixel data. Additionally, the "brightness value of the pixel data" is a value uniquely determined for a single piece of the pixel data, as the brightness value Y in the YUV color system that is determined using the expression (1). For example, the "brightness value of the pixel data" is different from a value (e.g., a measured value) representing brightness of a color actually displayed on the pixel of the display unit 270 using the pixel data. The brightness of the color actually displayed on the pixel of the display unit 270 varies depending on the maximum luminescence level of the display unit 270, even though the same pixel data is used to display the color. That is, the brightness of the color actually displayed on the pixel of the display unit 270 is not uniquely determined for a single piece of the pixel data. In contrast, the "brightness value of the pixel data" is a value contained in the pixel data as a pixel value representing brightness. Specifically, the "brightness value of the pixel data" may include a Y value when the pixel data is expressed in the YUV color system or the YCaCb color system, a *L value when the pixel data is expressed in the CIELab color system, and a Hue value when the pixel data is expressed in the HSV color system. Further, the "brightness value of the pixel data" may include a value (a component value) representing brightness, the value obtained through conversion using a conversion equation with the pixel value contained in the pixel data as the only input variable for the equation. For instance, the "brightness value of the pixel data" may include a brightness value or a lightness value in each of various color systems (e.g., a Y value in the YUV color system or the YCaCb color system, a *L value in the CIELab color system, and a Hue value in the HSV color system) that is obtained through conversion using a conversion equation with the pixel value contained in the pixel data as the only input variable for the equation.

In the present disclosure, a "brightness of an image" represents brightness of the image expressed by the image data, more specifically, brightness of the image on the basis of brightness values of a plurality of pieces of pixel data constituting the image data of the image. The "brightness of the image" is different from brightness of the image actually displayed on the display unit 270 using the image data. The "brightness of the image" is represented by a feature value uniquely determined for each individual piece of image data. For instance, the "brightness of the image" may be represented by a statistical value determined using the brightness values of the pixel data constituting the image data of the image or values (e.g., the R values, the G values, and the B values) correlated with the brightness values of the pixel data. The average pixel value Vave determined in S30 is an example of the feature value representing the "brightness of the image."

In S35, the feature value acquirer 130 determines a standard deviation σ of all the pixel values contained in the target image data (i.e., the pixel values three times as many as the pixel number M). The standard deviation σ is determined using the following expression (2).

$$\sigma = \sqrt{\frac{1}{n}\sum_{i=1}^{n}(Vi - Vave)^2} \quad \text{[Expression (2)]}$$

where "Vave" is the average pixel value Vave determined in S30, and "n" is the total number of the pixel values (n=the pixel number M×3).

In S40 to S70, the correction amount determining unit 145 determines a below-mentioned correction level AL of correction to the target image data using the backlight setting value BS acquired in S15, the average pixel value Vave determined in S30, and the standard deviation σ determined in S35. The correction level AL is determined to be one of five integers within a range of "−2" to "+2." As will be described in detail, when the correction level AL is "0," the correction is not applied to the target image data. When the correction level AL is one of the positive integers "+1" and "+2," such a correction for raising the brightness is implemented. A correction amount for raising the brightness when the correction level AL is "+2" is larger than a correction amount when the correction level AL is "+1." When the correction level AL is one of the negative integers "−1" and "−2," a correction for reducing the brightness is implemented. A correction amount for reducing the brightness when the correction level AL is "−2" is larger than a correction amount when the correction level AL is "−1."

Specifically, in S40, the correction amount determining unit 145 determines whether the backlight setting value BS acquired in S15 is "1" or "3." When determining that the backlight setting value BS is "1," that is, when the display unit 270 is operating in the low luminescence mode, the correction amount determining unit 145 determines a base correction level AL1 based on results of comparisons between the average pixel value Vave and two threshold values Tv1 and Tv2 (S45).

FIG. 6 is a table for explaining how to determine the base correction level AL1 The two threshold values Tv1 and Tv2 used when the display unit 270 is operating in the low luminescence mode are determined to be "96" and "128," respectively (Tv1=96, and Tv2=128), relative to the average pixel value Vave equal to one of values ranging from "0" to "255." As shown in FIG. 6, when the average pixel value Vave is less than the threshold value Tv1, the base correction level AL1 is determined to be "+2." When the average pixel value Vave is equal to or more than the threshold value Tv1 and less than the threshold value Tv2, the base correction level AL1 is determined to be "+1." When the average pixel value Vave is more than the threshold value Tv2, the base correction level AL1 is determined to be "0."

Namely, in S45, when the brightness of the target image is lower than a first standard, specifically, when the average pixel value Vave representing the brightness of the target image is less than the threshold value Tv2, the base correction level AL1 is determined such that the correction for raising the brightness is implemented. Meanwhile, when the brightness of the target image is equal to or higher than the first standard, specifically, when the average pixel value Vave representing the brightness of the target image is equal to or more than the threshold value Tv2, the base correction level AL1 is determined such that the correction for raising the brightness is not implemented.

When the backlight setting value BS is "3," that is, when the display unit 270 is operating in the high luminescence mode, the correction amount determining unit 145 determines the base correction level AL1 based on results of comparisons between the average pixel value Vave and two threshold values Tv3 and Tv4 (S50).

The two threshold values Tv3 and Tv4 used when the display unit 270 is operating in the high luminescence mode are determined to be "120" and "150," respectively (Tv3=120, and Tv4=150). As shown in FIG. 6, when the average pixel value Vave is less than the threshold value Tv3, the base correction level AL1 is determined to be "0." When the average pixel value Vave is equal to or more than the threshold value Tv3 and less than the threshold value Tv4, the base correction level AL1 is determined to be "−1." When the average pixel value Vave is more than the threshold value Tv4, the base correction level AL1 is determined to be "−2."

Namely, in S50, when the brightness of the target image is lower than a second standard, specifically, when the average pixel value Vave representing the brightness of the target image is less than the threshold value Tv3, the base correction level AL1 is determined such that the correction for lowering the brightness is not implemented. Meanwhile, when the brightness of the target image is equal to or higher than the second standard, specifically, when the average pixel value Vave representing the brightness of the target image is equal to or more than the threshold value Tv3, the base correction level AL1 is determined such that the correction for lowering the brightness is not implemented.

After determining the base correction level AL1 in a subsequent step S55, the backlighting determining unit 150 determines whether the target image expressed by the target image data is a backlighting image, using the standard deviation σ determined in S35. Specifically, the backlighting determining unit 150 determines that the target image is a backlighting image when the standard deviation σ is more than a predetermined threshold value Tr. Meanwhile, the backlighting determining unit 150 determines that the target image is not a backlighting image but a direct light image when the standard deviation σ is equal to or less than the predetermined threshold value Tr.

As described above, FIG. 5A shows a histogram HG of the target image data expressing the target image which is a direct light image taken in a direct light condition. As shown in FIG. 5A, the direct light image is expressed with a relatively small difference between the brightness of the subjects SB and the brightness of the background BG. Therefore, in the direct light image, a plurality of pixel values that express the subjects SB and a plurality of pixel values that express the background BG distribute around a median value of a possible value range of the pixel values, but do not eccentrically distribute around a lower end (the darkest value) or an upper end (the brightest value) of the possible value range of the pixel values. On the contrary, as shown in FIG. 5B, in the backlighting image, the subjects SB are relatively dark, and the background BG is relatively bright. Therefore, in the backlighting image, a plurality of pixel values that express the subjects SB eccentrically distribute around the lower end (the darkest value) of the possible value range of the pixel values. Further, a plurality of pixel values that express the background BG eccentrically distribute around the upper end (the brightest value) of the possible value range of the pixel values. Accordingly, in general, a standard deviation σ of the target image which is a backlighting image is larger than a standard deviation σ of the target image which is a direct light image. Therefore, it is possible to accurately determine whether the target image is a backlighting image, based on a result of comparison between the standard deviation σ and the predetermined threshold value Tr appropriately set. In the first embodiment, the threshold value Tr is set to "70."

When the backlighting determining unit 150 determines that the target image is a backlighting image (S55: Yes), the correction amount determining unit 145 sets an additional correction level AL2 to "1" (S60). Meanwhile, when the backlighting determining unit 150 determines that the target image is not a backlighting image (S55: No), the correction amount determining unit 145 sets the additional correction level AL2 to "0" (S65).

In S70, the correction amount determining unit 145 determines a final correction level AL. The final correction level AL is determined using the base correction level AL1 determined based on the average pixel value Vave and the additional correction level AL2 determined based on the standard deviation σ. Specifically, the correction amount determining unit 145 sets the final correction level AL to the sum of the base correction level AL1 and the additional correction level AL2.

The additional correction level AL2 is a value for modifying the base correction level AL1 based on whether the target image is a backlighting image. Namely, when the target image is a backlighting image, "1" is added to the base correction level AL1 Meanwhile, when the target image is not a backlighting image, no addition is made to the base correction level AL1. Adding "1" to the base correction level AL1 means to change the correction level by one level in such a direction as to raise the brightness of the image expressed by the corrected image data.

As understood from FIG. 6, when the display unit 270 is operating in the low luminescence mode, the base correction level AL1 is one of "0," "1," and "2." Further, the additional correction level AL2 is one of "0" and "1." Therefore, the sum "AL1+AL2" is one of four integers within a range of "0" to "3." In the first embodiment, the final correction level AL is set within the possible value range of the base correction level AL1. Therefore, when the display unit 270 is operating in the low luminescence mode, even though the sum "AL1+AL2" is "3," the final correction level AL is exceptionally set to the upper limit "2" of the possible values of the base correction level AL1.

When the display unit 270 is operating in the high luminescence mode, the base correction level AL1 is one of "0," "−1," and "−2." Further, the additional correction level AL2 is one of "0" and "1." Therefore, the sum "AL1+AL2" is one of four integers within a range of "−2" to "1." In the first embodiment, when the display unit 270 is operating in the high luminescence mode, even though the sum "AL1+AL2" is "1," the final correction level AL is exceptionally set to the upper limit "0" of the possible values of the base correction level AL1. Namely, when the display unit 270 is operating in the high luminescence mode, the image actually displayed on the display unit 270 is brighter than an image that would be displayed according to the same image data on the display unit 270 operating in the normal luminescence mode. Nonetheless, correction for further raising the brightness of the target image is not applied. This is because, when the display unit 270 is operating in the high luminescence mode, the correction is applied for the purpose of preventing the image actually displayed on the display unit 270 from having a lower level of visual quality than an image that would be displayed according to the same target image data on the display unit 270 operating in the normal luminescence mode, but not for the purpose of correcting a backlighting image.

In S75, the correction amount determining unit 145 selects one-dimensional lookup tables to be used for the correction, based on the determined correction level AL. FIG. 7 exemplifies one-dimensional lookup tables used for the correction. FIG. 7 shows four one-dimensional lookup tables, which correspond to the four values "−2,""−1,""+1," and "+2," except "0," of all the possible values (i.e., the five integers) of the correction level AL ranging from "−2" to "+2." In FIG. 7, the four one-dimensional lookup tables are shown with reference characters "L (AL)" (such as "L (−2),""L (−1),""L (+1)," and "L (+2),") using the respective values of the corresponding correction levels AL. It is noted that, when the correction level AL is "0," the correction is not applied to the target image data.

Each one-dimensional lookup table is a table associating input values Pin with output values Pout. FIG. 7 shows curves plotted with the input values Pin as horizontal-axis values and the output values Pout as vertical-axis values. In the first embodiment, as shown in FIG. 7, the curves representing the one-dimensional lookup tables are known γ-curves expressed by the following expression (3).

$$Pout = 255 \times \left(\frac{Pin}{255}\right)^{\frac{1}{\gamma}} \quad \text{[Expression (3)]}$$

where"255" is the maximum gradation value.

In the first embodiment, each one-dimensional lookup table is previously created to determine such a shape of the γ-curve that an output value Pout corresponding to a median input value Pin_M is equal to a design value k (AL) depending on the correction level AL. The median input value Pin_M is a median (in the first embodiment, 128) in the range (in the first embodiment, 0 to 255) of the possible values of the input value Pin. In the first embodiment, the four design values k (−2), k (−1), k (1), and k (2) are "96," "112," "140," and "160," respectively. The previously created four one-dimensional lookup tables are stored as the correction profiles 227 in the non-volatile storage device 220 (see FIG. 1).

The one-dimensional lookup tables L (+1) and L (+2) are formed in an upward-convex shape to apply the correction for raising the brightness of the target image. Hereinafter, a correction using the one-dimensional lookup table L (+1) may be referred to as a first correction. Further, a correction using the one-dimensional lookup table L (+2) may be referred to as a second correction.

The one-dimensional lookup tables L (−1) and L (−2) are formed in a downward-convex shape to apply the correction for reducing the brightness of the target image. Hereinafter, a correction using the one-dimensional lookup table L (−1) may be referred to as a third correction. Further, a correction using the one-dimensional lookup table L (−2) may be referred to as a fourth correction.

In the two types of corrections for raising the brightness, a correction amount of the second correction is larger than a correction amount of the first correction. In the two types of corrections for reducing the brightness, a correction amount of the fourth correction is larger than a correction amount of the third correction.

In S80, the correction unit 140 corrects the target image data using the one-dimensional lookup table selected in S75. Specifically, the correction unit 140 refers to the one-dimensional lookup table with the pixel values contained in the target image data as input values Pin, and acquires output values Pout corresponding to the input values Pin. The correction unit 140 converts the pixel values applied as the input values Pin to the corresponding output values Pout. The correction unit 140 creates the corrected target image data by performing the conversion for every pixel value contained in the target image data.

In S58, the display controller 160 displays on the display unit 270 an image based on the corrected target image data. Specifically, in the first embodiment, since the target image data is the content image data, the display controller 160 creates image data expressing the UI screen image M1 with the corrected content image CI superimposed on the base image BM. Then, the display controller 160 displays on the display unit 270 an image (the UI screen image) based on the created image data.

As described above, according to the first embodiment, the UI processor 100 corrects the target image data using the feature value representing the brightness of the target image (specifically, the average pixel value Vave) and the setting value regarding the maximum luminescence level of the display unit 270 (specifically, the backlight setting value BS). Then, the UI processor 100 displays on the display unit 270 the image based on the corrected target image data. Consequently, the UI processor 100 is allowed to display on the display unit 270 the image with a brightness appropriately adjusted based on the maximum luminescence level of the display unit 270 and a feature regarding the brightness of the target image. Accordingly, the UI processor 100 is allowed to prevent reduction in a visual quality level of the image displayed on the display unit 270 configured to change the maximum luminescence level.

When the maximum luminescence level of the display unit 270 is rendered lower than the reference luminescence level (e.g., the standard maximum luminescence level in the normal luminescence mode) as the MFP 200 is set in the energy-saving mode, an image actually displayed on the display unit 270 is darker than an image that would be displayed according to the same image data on the display unit 270 operating in the normal luminescence mode. For instance, when the content image CI shown in FIG. 4 is actually displayed on the display unit 270, faces of the persons represented by the subjects SB are likely to be displayed dark. In such a case, according to the first embodiment, the correction for raising the brightness values of the pixel data of the target image data is applied to the target image data. Thus, it is possible to improve the visual quality of the image displayed on the display unit 270 using the corrected target image data.

FIG. 8 exemplifies correction levels for images when the backlight setting value BS is "1" (the low luminescence mode). FIG. 8 shows correction levels set by the UI processor 100 of the first embodiment to display images 1 to 12 using 12 pieces (samples) of target image data.

As shown in FIG. 8, when the backlight setting value BS is "1," the correction level AL is set to "+2" for the image 2 (see FIG. 8) having an average pixel value Vave less than the threshold value Tv1. Namely, to image data expressing an image having a relatively low brightness, specifically, to the image data expressing the image 2 (see FIG. 8) having the average pixel value Vave less than the threshold value Tv1, applied is the second correction for raising the brightness by a relatively large correction amount.

Further, when the backlight setting value BS is "1," the correction level AL is set to "+1" for the image 10 (see FIG. 8) having an average pixel value Vave equal to or more than the threshold value Tv1 and less than the threshold value Tv2. Namely, to image data expressing an image having a medium level of brightness, specifically, to the image data expressing the image 10 (see FIG. 8) having the average pixel value Vave equal to or more than the threshold value Tv1 and less than the threshold value Tv2, applied is the first correction for raising the brightness by a relatively small correction amount.

As understood from the above descriptions, when the maximum luminescence level of the display unit 270 is lower than the reference luminescence level (BS=1), the correction unit 140 applies the first correction for raising the brightness to the target image data expressing the image 10 (see FIG. 8). Further, the correction unit 140 applies the second correction for raising the brightness to the target image data expressing the image 2 (see FIG. 8) that has a brightness lower than the brightness of the image 10. As described above, the correction amount (a degree or extent to which the brightness is raised) of the second correction is larger than the correction amount of the first correction.

When the display unit 270 operates in the low luminescence mode, an image having a lower brightness tends to be displayed more excessively dark with its visual quality being more deteriorated. Accordingly, there is a greater need to apply the correction for raising the brightness to such an image having a lower brightness. In the first embodiment, when the display unit 270 is set in the low luminescence mode, a larger correction amount is applied to a target image (e.g., the image 2) having a relatively low brightness than to a target image (e.g., the image 10) having a relatively high brightness. Consequently, it is possible to adequately prevent deterioration of the visual quality of the image displayed on the display unit 270, by appropriately adjusting the brightness of the target image.

Further, as shown in FIG. 8, when the backlight setting value BS is "1," the correction level AL for the image 12, which has an average pixel value Vave equal to or more than the threshold value Tv2 (in the first embodiment, Tv2=128), is set to "0." Consequently, the correction for raising the brightness is not applied to the target image data expressing the image 12.

When the backlight setting value BS is "1," as described above, the correction for raising the brightness (the first correction or the second correction) is applied, e.g., to (the target image data expressing) the image 10 or the image 2, which has an average pixel value Vave less than the threshold value Tv2.

Namely, when the backlight setting value BS is "1," i.e., when the backlight setting value BS represents that the maximum luminescence level is lower than the reference luminescence level, the correction unit 140 of the UI processor 100 applies the correction for raising the brightness to the target image data expressing the image 10 or the image 2. Meanwhile, the correction unit 140 does not apply the correction for raising the brightness to the target image data expressing the image 12, which has a brightness higher than those of the image 10 and the image 2.

When the display unit 270 operates in the low luminescence mode, an image having a relatively low brightness (e.g., the image 10 and the image 2) is relatively likely to be displayed with its visual quality being deteriorated. Meanwhile, an image having a relatively high brightness (e.g., the image 12) is relatively likely to be displayed without its visual quality being deteriorated. According to the aforementioned configuration, the UI processor 100 appropriately corrects an image that is relatively likely to be displayed with its visual quality being deteriorated, so as to prevent deterioration of the visual quality of the image. Moreover, the UI processor 100 does not correct an image that is relatively likely to be displayed without its visual quality being deteriorated, so as to avoid execution of unnecessary correction.

Meanwhile, when the high luminescence mode is set, and the maximum luminescence level of the display unit 270 is higher than the reference luminescence level, the image actually displayed on the display unit 270 is brighter than an image that would be displayed on the display unit 270 operating in the normal luminescence mode. For instance, in the content image CI shown in FIG. 4, blown out highlights are likely to be caused in the subject SB and the background BG. In such a case, according to the first embodiment, to the target image data, applied is the correction for reducing the brightness values of the pixel data of the target data. Therefore, it is possible to improve the visual quality of the image displayed on the display unit 270 using the corrected target image data.

FIG. 9 exemplifies correction levels for the images 1 to 12 when the backlight setting value BS is "3" (the high luminescence mode). FIG. 8 shows correction levels set by the UI processor 100 of the first embodiment to display the images 1 to 12 using the same 12 pieces (samples) of target image data as shown in FIG. 8.

As shown in FIG. 9, when the backlight setting value BS is "3," the correction level AL is set to "−2" for the image 12 having an average pixel value Vave equal to or more than the threshold value Tv4. Consequently, to the image data expressing the image 12, applied is the fourth correction for lowering the brightness by a relatively large correction amount.

Further, when the backlight setting value BS is "3," the correction level AL is set to "−1" for the image 1 having an average pixel value Vave equal to or more than the threshold value Tv3 and less than the threshold value Tv4. Consequently, to the image data expressing the image 1, applied is the third correction for lowering the brightness by a relatively small correction amount.

As understood from the above descriptions, when the maximum luminescence level of the display unit 270 is higher than the reference luminescence level (BS=3), the correction unit 140 applies the third correction for lowering the brightness to the target image data expressing the image 1 (see FIG. 9). Further, the correction unit 140 applies the fourth correction for lowering the brightness to the target image data expressing the image 12 that has a brightness higher than the brightness of the image 1. As described above, the correction amount (a degree or extent to which the brightness is lowered) of the fourth correction is larger than the correction amount of the third correction.

When the display unit 270 operates in the high luminescence mode where the maximum luminescence level is higher than the reference luminescence level, an image having a higher brightness tends to be displayed more excessively brighter (e.g., with blown out highlights) with its visual quality being more deteriorated. Accordingly, there is a greater need to apply the correction for lowering the brightness to such an image having a higher brightness. In the first embodiment, when the display unit 270 is set in the high luminescence mode, a larger correction amount is applied to a target image (e.g., the image 12) having a relatively high brightness than to a target image (e.g., the image 1) having a relatively low brightness. Consequently, it is possible to adequately prevent deterioration of the visual quality of the image displayed on the display unit 270, by appropriately adjusting the brightness of the target image.

Further, as shown in FIG. 9, when the backlight setting value BS is "3," the correction level AL for an image having a relatively low brightness, specifically for the image 7 (see FIG. 9) having an average pixel value Vave less than the threshold value Tv3 (in the first embodiment, Tv3=120), is set to "0." Consequently, the correction for lowering the brightness is not applied to the target image data expressing the image 7.

When the backlight setting value BS is "3," as described above, the correction for lowering the brightness (the third correction or the fourth correction) is applied, e.g., to (the target image data expressing) the image 1 or the image 12, which has an average pixel value Vave equal to or more than the threshold value Tv3.

Namely, when the backlight setting value BS is "3," i.e., when the backlight setting value BS represents that the maximum luminescence level is higher than the reference luminescence level, the correction unit 140 of the UI processor 100 applies the correction for lowering the brightness to the target image data expressing the image 1 or the image 12. Meanwhile, the correction unit 140 does not apply the correction for lowering the brightness to the target image data expressing the image 7, which has a brightness lower than those of the image 1 and the image 12.

When the display unit 270 operates in the low luminescence mode where the maximum luminescence level is higher than the reference luminescence level, an image having a relatively high brightness (e.g., the image 1 and the image 12) is relatively likely to be displayed with its visual quality being deteriorated. Meanwhile, an image having a relatively low brightness (e.g., the image 12) is relatively likely to be displayed without its visual quality being deteriorated. According to the aforementioned configuration, the UI processor 100 appropriately corrects an image that is relatively likely to be displayed with its visual quality being deteriorated, so as to prevent deterioration of the visual quality of the image. Moreover, the UI processor 100 does not correct an image that is relatively likely to be displayed without its visual quality being deteriorated, so as to avoid execution of unnecessary correction.

Further, the backlighting determining unit 150 determines whether the target image is a backlighting image, using the target image data to be processed. As described above, when the target image is a backlighting image, the correction unit 140 corrects the target image data such that the target image expressed by the corrected target image data has a higher brightness than when the target image is not a backlighting image.

For example, in FIG. 8, the brightness of the image 8 is as high as the brightness of the image 3. Namely, the average pixel value Vave of the image 8 is about 119, and the average pixel value Vave of the image 3 is about 122. As the standard deviation σ (about 65) of the image 8 is lower than the reference value (the threshold value Tr=70), it is determined that the image 8 is not a backlighting image. Meanwhile, as the standard deviation σ (about 97) of the image 3 is higher than the reference value (the threshold value Tr=70), it is determined that the image 3 is a backlighting image. Then, as shown in FIG. 8, the correction level AL for the target image data expressing the image 8, which is not determined to be a backlighting image, is set to "1." In addition, the correction level AL for the target image data expressing the image 3, which is determined to be a backlighting image, is set to "2."

Further, in FIG. 9, the brightness of the image 12 is as high as the brightness of the image 6. Namely, the average pixel value Vave of the image 12 is about 166, and the average pixel value Vave of the image 6 is about 152. As the standard deviation σ (about 67) of the image 12 is lower than the reference value (the threshold value Tr=70), it is determined that the image 12 is not a backlighting image. Meanwhile, as the standard deviation σ (about 96) of the image 6 is higher than the reference value (the threshold value Tr=70), it is determined that the image 6 is a backlighting image. Then, as shown in FIG. 9, the correction level AL for the target image data expressing the image 12, which is not determined to be a backlighting image, is set to "−2." In addition, the correction level AL for the target image data expressing the image 6, which is determined to be a backlighting image, is set to "−1."

In the backlighting image, since the brightness of the subject is relatively low, and the brightness of the background is relatively high, the brightness of the subject is lower than the brightness represented by the average pixel value Vave. It is considered that the visual quality of the whole image depends more on the visual quality of the subject than the visual quality of the background. In the first embodiment, when the target image is a backlighting image, it is possible to determine an appropriate correction level AL for the target image in consideration of the brightness of the subject in the backlighting image, by modifying the base correction level AL1 based on the average pixel value Vave by one level in such a direction as to raise the brightness of the image expressed by the corrected target image data. Accordingly, it is possible to appropriately correct the brightness of the target image so as to improve the visual quality of the image actually displayed on the display unit 270, depending on whether the target image is a backlighting image.

In the first embodiment, the average pixel value Vave is employed as a feature value representing the brightness of the target image. Consequently, it is possible to display an image having a brightness appropriately adjusted depending on the brightness of the target image and the maximum luminescence level of the display unit 270. Further, the average pixel value Vave is a simple average value of all the pixel values of the target image data. Therefore, it is easy to determine the average pixel value Vave, and it is possible to display an image having an appropriate brightness in a relatively fast manner.

Further, in the first embodiment, the correction amount determining unit 145 determines the correction level A1, i.e., a correction amount of the correction for adjusting the brightness, based on the result of the comparison between the average pixel value Vave and the predetermined threshold values Tv1 to Tv4, and the backlight setting value BS. Accordingly, it is possible to easily determine an appropriate correction level. The display unit 270 of the MFP 200 is not a display device for the user to appreciate images thereon. In this regard, the display unit 270 is different from display devices such as television sets and projectors. Therefore, in most cases, a controller (e.g., the CPU 210) for controlling the display unit 270 is allowed to use relatively few resources for display on the display unit 270. In the first embodiment, it is possible to achieve a required level of visual quality for the display unit 270 of the MFP 200 with a relatively small number of transactions (a relatively small amount of processing).

The display unit 270 of the first embodiment is a LCD device that includes the LCD panel 272 and the backlight 274. The backlight setting value BS is a setting value of the illumination intensity of the backlight 274. According to the above configuration, for instance, even though the illumination intensity of the backlight 274 is changed in view of power consumption, and the maximum luminescence level of the display unit 270 is rendered lower, it is possible to prevent deterioration of the visual quality of the image displayed on the display unit 270.

B. Second Embodiment

In the aforementioned first embodiment, the correction amount determining unit 145 sets the correction amount (defined by the correction level AL) in a stepwise manner (specifically, with one of the possible five values of the correction level AL) depending on the average pixel value Vave of the target image. Alternatively, the correction amount determining unit 145 may change a correction amount in a continuous manner depending on the average pixel value Vave of the target image.

FIGS. 10A and 10B show relationships between the average pixel value Vave and a γ value, in order to describe setting of a correction amount in a second embodiment. In the second embodiment, a γ value of a γ-curve corresponds to a correction amount (see FIG. 7). FIG. 10A shows an example when the backlight setting value BS is "1," that is, when the display unit 270 is set in the low luminescence mode.

In the example shown in FIG. 10A, when the average pixel value Vave of the target image is equal to or less than a threshold value VL1, the γ value as a correction amount is set to a maximum value γH. The maximum value γH defines a maximum correction amount for the correction for raising the brightness. In the second embodiment, the threshold value VL1 is "96," which is the same value as the threshold value Tv1 in the first embodiment. Nonetheless, the threshold value VL1 may be different from the threshold value Tv1 in the first embodiment. For example, the maximum value γH of the γ value may be set to "3.0."

Further, when the average pixel value Vave is equal to or more than a threshold value VH1, the γ value is set to "1.0" (γ=1.0). Here, "γ=1.0" means that any correction for adjusting the brightness is not applied (i.e., the correction amount is zero). Namely, when the average pixel value Vave is adequately large, as the target image originally has an adequately high brightness, any correction for raising the brightness is not applied. In the second embodiment, the threshold value VH1 is "160," which is larger than the threshold value Tv2 (128) in the first embodiment. Nonetheless, the threshold value VH1 in the second embodiment may be the same as the threshold value Tv2 (128) in the first embodiment.

When the average pixel value Vave is more than the threshold value VL1 and less than the threshold value VH1, the γ value is set to such a value as to be linearly larger as the average pixel value Vave is smaller, within a range "1.0<γ<3.0." Namely, when the average pixel value Vave is more than the threshold value VL1 and less than the threshold value VH1, the correction amount is set to such an amount as to be linearly larger as the brightness of the target image is lower (the target image is darker), within a range more than zero and less than the maximum correction amount.

FIG. 10B shows an example when the backlight setting value BS is "3," that is, when the display unit 270 is set in the high luminescence mode.

In the example shown in FIG. 10B, when the average pixel value Vave of the target image is equal to or less than a threshold value VL2, the γ value is set to "1.0" (γ=1.0). Namely, when the average pixel value Vave is adequately small, as the target image originally has an adequately low brightness, any correction for lowering the brightness is not applied. In the second embodiment, the threshold value VL2 is "120," which is the same value as the threshold value Tv3 in the first embodiment. Nonetheless, the threshold value VL2 may be different from the threshold value Tv3 in the first embodiment.

When the average pixel value Vave is more than the threshold value VL2, the γ value is set to a minimum value γL. The minimum value γL defines a maximum correction amount for the correction for lowering the brightness. In the second embodiment, the threshold value VH2 is "180," which is larger than the threshold value Tv4 (140) in the first embodiment. Nonetheless, the threshold value VH2 may be the same as the threshold value Tv4 in the first embodiment. For example, the minimum value γL of the γ value may be set to "⅓."

When the average pixel value Vave is more than the threshold value VL2 and less than the threshold value VH2, the γ value is set to such a value as to be linearly smaller as the average pixel value Vave is smaller, within a range "(⅓)<γ<1.0." Namely, when the average pixel value Vave is more than the threshold value VL2 and less than the threshold value VH2, the correction amount is set to such an amount as to be linearly larger as the brightness of the target image is higher (the target image is brighter), within a range more than zero and less than the maximum correction amount.

When the target image is a backlighting image, for instance, the correction amount determining unit 145 may determine a modified average pixel value Vave2 by subtracting a predetermined value (e.g., 20) from the average pixel value Vave, and may determine a γ value corresponding to the modified average pixel value Vave2, based on the relationships (between the average pixel value Vave and the γ value) shown in FIGS. 10A and 10B.

In the second embodiment, it is possible to improve the visual quality of the image depending on the average pixel value Vave of the image and the backlight setting value BS, in the same manner as the first embodiment. Further, in the second embodiment, it is possible to more appropriately enhance the visual quality of the image by more finely determining the correction amount. In contrast, in the first embodiment, it is possible to improve the visual quality of the image with a smaller number of transactions (a smaller amount of processing), by determining the correction amount in a simpler method. Namely, in the first embodiment, the correction is applied to the target image data using one table selected from among the previously created four one-dimensional lookup tables. On the contrary, in the second embodiment, a one-dimensional lookup table is created depending on the average pixel value Vave. Therefore, the second embodiment requires a higher processing load of the CPU 210 than the first embodiment.

Hereinabove, the embodiments according to aspects of the present invention have been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only exemplary embodiments of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are possible. It is noted that, in the following modifications, explanations of the same configurations as exemplified in the aforementioned embodiments will be omitted.

C. Modifications

In the aforementioned embodiments, the display unit 270 is allowed to be set in any one of the three modes, i.e., the normal luminescence mode, the low luminescence mode (the energy-saving mode), and the high luminescence mode. However, for instance, the display unit 270 may be set in any one of the two modes of the normal luminescence mode and the low luminescence mode (the energy-saving mode). Alternatively, the display unit 270 may be set in any one of the two modes of the normal luminescence mode and the high luminescence mode. In these cases, the UI processor 100 may be configured to implement corrections corresponding to the settable modes. Moreover, the low luminescence mode may contain not only one mode but two or more sub modes, e.g., a first low luminescence mode and a second low luminescence mode where the maximum luminescence level is lower than in the first low luminescence mode. In this case, the UI processor 100 may determine such a correction amount, for the correction for raising the brightness, as to be larger in the second low luminescence mode where the maximum luminescence level is lower. In the same manner, the high luminescence mode may contain not only one mode but two or more sub modes, e.g., a first high luminescence mode and a second high luminescence mode where the maximum luminescence level is higher than in the first high luminescence mode. In this case, the UI processor 100 may determine such a correction amount, for the correction for lowering the brightness, as to be larger in the second high luminescence mode where the maximum luminescence level is higher.

In the aforementioned embodiments, the average pixel value Vave is employed as a feature value representing the brightness of the target image. However, another feature value may be employed. For instance, an average brightness value or an average luminosity value may be employed as a feature value representing the brightness of the target image. The average brightness value may be a value obtained by determining a Y value in the YCrCb color space or the YUV color space for every pixel of the target image data and determining an average value of the Y values of all the pixels. The average luminosity value may be a value obtained by determining anH value in the HSV color space or an *L value in the CIELAB color space for every pixel of the target image data and determining an average value of the H values or the *L values of all the pixels. Further, the feature value representing the brightness of the target image may not necessarily be a value directly representing the brightness of the target image, but may be a value correlated with the brightness of the target image and obtained by using a plurality of pixel values contained in the target image data. For example, the number of pieces of pixel data having a brightness value Y equal to or more than a reference value, of all the pieces of pixel data contained in the target image data, may be employed as a feature value representing the brightness of the target image. Alternatively, the number of pieces of pixel data having a brightness value Y equal to or less than a reference value, of all the pieces of pixel data contained in the target image data, may be employed as a feature value representing the brightness of the target image. The number of pieces of pixel data having a brightness value Y equal to or less than a reference value is an example of a feature value having a negative correlation with the brightness of the target image.

In the aforementioned embodiments, the correction using the one-dimensional lookup table defining a γ-curve is applied to every piece of pixel data contained in the target image data, as a correction for adjusting the brightness. Instead, for instance, the UI processor 100 may perform image processing to extract a plurality of pieces of pixel data constituting a major subject from the target image data, and may apply a correction for adjusting the brightness only to the extracted pieces of pixel data. Further, the UI processor 100 may multiply every piece of pixel data contained in the target image data by a coefficient K (e.g., K=0.8) within a range "$0<K<1.0$," as the correction for lowering the brightness.

In the aforementioned first embodiment, the correction for adjusting the brightness of the target image includes the five different levels of correction, i.e., the two different levels of correction for raising the brightness, the two different levels of correction for lowering the brightness, and the level of "no correction applied." However, the correction for adjusting the brightness of the target image may include one level of correction for raising the brightness and one level of correction for raising the brightness. Alternatively, the correction for adjusting the brightness of the target image may include three or more different levels of correction for raising the brightness and three or more different level of correction for raising the brightness. Further, the number of levels of the correction for raising the brightness may be different from the number of levels of the correction for lowering the brightness. Further, the correction for adjusting the brightness of the target image may not include the level of "no correction applied" (the correction level AL=0). In other words, when the display unit 270 is set in the low luminescence mode or the high luminescence mode, the correction for adjusting (changing) the brightness may necessarily be applied to the target image data.

In the aforementioned first embodiment, when the target image is a backlighting image, the correction level AL is determined with the additional correction level AL2 equal to "1" added to the base correction level AL1. However, the addition of the additional correction level AL2 may be omitted. In this case, it is possible to further reduce the processing load of the UI processor 100.

The determination as to whether the target image is a backlighting image is not limited to a determination using the standard deviation σ but may be achieved using various methods. For example, the backlighting determining unit 150 may perform image processing to specify a major subject in the target image, and may determine that the target image is a backlighting image when an average brightness value of the specified major subject is less than a reference value.

In the aforementioned embodiments, the image displaying operations are performed for the content image data, as the target image data, which expresses the content image CI that may include photographic images. However, the image displaying operations may be performed for a UI screen image, as a target image, which includes operation buttons and does not include a content image CI. In this case, it is possible to improve the visual quality of the UI screen image. Further, in this case, it is possible to omit the determination as to whether the target image is a backlighting image, since the target image does not include a photographic image.

The display unit 270 is not limited to an LCD device but may be a plasma display device or an organic electroluminescence display device. In general, the display unit 270 may be any type of display device configured to change the maximum luminescence level.

Aspects of the present invention may be applied to not only the control of the display unit 270 of the MFP 200 that displays a UI screen image but also display units of other electronic devices, which may include image processors such as printers, image scanners, and digital cameras, and mobile terminal devices such as smartphones and tablet terminal devices.

A part of the configurations achieved by hardware in the aforementioned embodiments may be achieved by software. On the contrary, a part of the configurations achieved by software in the aforementioned embodiments may be achieved by hardware.

What is claimed is:

1. A display device comprising:

a display unit configured to change a maximum luminescence level;

a processor; and a storage device storing processor-executable instructions configured to, when executed by the processor, cause the processor to serve as:

a luminescence-level setting acquirer configured to acquire a luminescence-level setting value representing the maximum luminescence level of the display unit;

an image data acquirer configured to acquire target image data;

a feature value acquirer configured to acquire a feature value representing a brightness of a target image expressed by the target image data, the feature value being determined using a plurality of pixel values contained in the target image data;

a correction unit configured to correct the target image data by adjusting the brightness of the target image using the luminescence-level setting value representing the maximum luminescence level of the display unit and the feature value representing the brightness of the target image expressed by the target image data; and a display controller configured to control the display unit to display the target image expressed by the corrected target image data, wherein the image data acquirer is configured to acquire, as the target image data, first target image data expressing a first target image having a first brightness and second target image data expressing a second target image having a second brightness higher than the first brightness, and wherein the correction unit is configured to, when the luminescence-level setting value is a particular value representing that the maximum luminescence level of the display unit is higher than a reference level, apply to the first target image data a first correction for lowering the first brightness by a first correction amount, and apply to the second target image data a second correction for lowering the second brightness by a second correction amount, the second correction amount when the luminescence-level setting value is the particular value being larger than the first correction amount when the luminescence-level setting value is the particular value.

2. The display device according to claim 1, wherein the image data acquirer is configured to acquire:

the first target image data expressing the first target image having the first brightness;

the second target image data expressing the second target image having the second brightness; and third target image data expressing a third target image having a third brightness, wherein the feature value acquirer is configured to acquire:

a first feature value having a positive correlation with the first brightness of the first target image expressed by the first target image data, using a plurality of pixel values contained in the first target image data, the first feature value being equal to or more than a first threshold value and less than a second threshold value;

a second feature value having a positive correlation with the second brightness of the second target image expressed by the second target image data, using a plurality of pixel values contained in the second target image data, the second feature value being equal to or more than the second threshold value; and a third feature value having a positive correlation with the third brightness of the third target image expressed by the third target image data, using a plurality of pixel values contained in the third target image data, the third feature value being less than the first threshold value, and wherein the correction unit is configured to, when the setting value represents that the maximum luminescence level of the display unit is higher than the reference level, apply, to the first target image data, the first correction for lowering the first brightness by the first correction amount, apply, to the second target image data, the second correction for lowering the second brightness by the second correction amount larger than the first correction amount, and not apply, to the third target image data, a correction for adjusting the third brightness.

3. The display device according to claim 1, wherein the feature value acquired by the feature value acquirer is one of an average value of the plurality of pixel values and an average brightness value determined using the plurality of pixel values.

4. The display device according to claim 1, wherein the correction unit comprises a correction amount determining unit configured to determine a correction amount for adjusting the brightness of the target image, based on the setting value and a result of comparison between the feature value and a predetermined threshold value.

5. The display device according to claim 1, wherein the display unit comprises a liquid crystal panel and a backlight, and wherein the setting value is a setting value of an illuminance of the backlight.

6. The display device according to claim 1, wherein the feature value is one of an average value of the plurality of pixel values and an average brightness determined using the plurality of pixel values, wherein the correction unit comprises a correction amount determining unit configured to:

determine a first correction amount for determining a final correction amount for adjusting the brightness of the target image, based on the luminescence-level setting value and a result of comparison between the feature value and a predetermined threshold value;

determine a second correction amount for determining the final correction amount for adjusting the brightness of the target image, based on whether a standard deviation of the plurality of pixel values contained in the target image data is equal to or higher than a predetermined reference value; and determine the final correction amount for adjusting the brightness of the target image, based on the first correction amount and the second correction amount.

7. The display device according to claim 1, wherein the feature value is one of an average value of the plurality of pixel values and an average brightness determined using the plurality of pixel values, wherein the correction unit comprises a correction amount determining unit configured to:

determine a first correction amount for determining a final correction amount for adjusting the brightness of the target image, based on the luminescence-level setting value and a result of comparison between the feature value and a predetermined threshold value;

specify a major subject in the target image, and determine a second correction amount for determining the final correction amount for adjusting the brightness of the target image, based on whether an average brightness of the specified major subject is less than a particular reference value; and determine the final correction amount for adjusting the brightness of the target image, based on the first correction amount and the second correction amount.

8. The display device according to claim 1, wherein the image data acquirer is configured to acquire fourth target image data expressing a fourth target image having a fourth brightness and fifth target image data expressing a fifth target image having a fifth brightness lower than the fourth brightness, and wherein the correction unit is configured to, when the setting value represents that the maximum luminescence level of the display unit is lower than a reference level, apply to the fourth target image data a fourth correction for raising the fourth brightness by a fourth correction amount, and apply to the fifth target image data a fifth correction for raising the fifth brightness by a fifth correction amount larger than the fourth correction amount.

9. The display device according to claim 8, wherein the image data acquirer is configured to acquire:

the fourth target image data expressing the fourth target image having the fourth brightness;

the fifth target image data expressing the fifth target image having the fifth brightness; and sixth target image data expressing a sixth target image having a sixth brightness, wherein the feature value acquirer is configured to acquire:

a fourth feature value having a positive correlation with the fourth brightness of the fourth target image expressed by the fourth target image data, using a plurality of pixel values contained in the fourth target image data, the fourth feature value being less than a fourth threshold value;

a fifth feature value having a positive correlation with the fifth brightness of the fifth target image expressed by the fifth target image data, using a plurality of pixel values contained in the fifth target image data, the fifth feature value being equal to or more than the fourth threshold value and less than a fifth threshold value; and a sixth feature value having a positive correlation with the sixth brightness of the sixth target image expressed by the sixth target image data, using a plurality of pixel values contained in the sixth target image data, the sixth feature value being equal to or more than the fifth threshold value, and wherein the correction unit is configured to, when the setting value represents that the maximum luminescence level of the display unit is lower than the reference level, apply, to the fourth target image data, the fourth correction for raising the fourth brightness by the fourth correction amount, apply, to the fifth target image data, the fifth correction for raising the fifth brightness by the fifth correction amount larger than the fourth correction amount, and not apply, to the sixth target image data, a correction for adjusting the sixth brightness.

10. The display device according to claim 1, further comprising a backlighting determining unit configured to determine using the target image data whether the target image is a backlighting image taken in a backlighting condition, wherein the correction unit is configured to, when the backlighting determining unit determines that the target image is the backlighting image, correct the target image data such that the target image expressed by the corrected target image data has a higher brightness than when the target image is not the backlighting image.

11. The display device according to claim 10, wherein the feature value acquirer is configured to determine a standard deviation of the plurality of pixel values contained in the target image data, and wherein the backlighting determining unit is configured to determine whether the target image is the backlighting image, using the standard deviation of the plurality of pixel values contained in the target image data.

12. The display device according to claim 1, wherein the correction unit comprises a correction amount determining unit configured to determine a correction amount for adjusting the brightness of the target image, based on the luminescence-level setting value and a result of comparison between the feature value and a predetermined threshold value, the predetermined threshold value varying depending on the luminescence-level setting value.

13. The display device according to claim 12, wherein the correction amount determining unit is further configured to, when the luminescence-level setting value represents that the maximum luminescence level of the display unit is higher than a first reference level, determine to:

correct the target image data when the brightness of the target image that is represented by the feature value is equal to or higher than a first threshold value as the predetermined threshold value; and not correct the target image data when the brightness of the target image that is represented by the feature value is lower than the first threshold value as the predetermined threshold value, and wherein the correction amount determining unit is further configured to, when the luminescence-level setting value represents that the maximum luminescence level of the display unit is lower than a second reference level, determine to:

correct the target image data when the brightness of the target image that is represented by the feature value is lower than a second threshold value as the predetermined threshold value; and not correct the target image data when the brightness of the target image that is represented by the feature value is equal to or higher than the second threshold value as the predetermined threshold value, the first reference level being equal to or higher than the second reference level, the first threshold value being lower than the second threshold value.

* * * * *